United States Patent [19]

Ling

[11] Patent Number: 4,733,548

[45] Date of Patent: Mar. 29, 1988

[54] ANTI-SENSING LOCKING MECHANISM FOR COMBINATION PADLOCK

[76] Inventor: Chong-Kuan Ling, P.O. Box 53-58, Taipei, Taiwan

[21] Appl. No.: 18,173

[22] Filed: Feb. 24, 1987

[51] Int. Cl.[4] ..... E05B 37/02

[52] U.S. Cl. ..... 70/25; 70/312

[58] Field of Search ..... 70/22, 25, 26, 312, 70/315–318, 323, 301, 311

[56] References Cited

U.S. PATENT DOCUMENTS

| | | | |
|---|---|---|---|
| 3,388,572 | 6/1968 | Morin | 70/25 |
| 3,720,082 | 3/1973 | Feinberg et al. | 70/25 |
| 4,259,856 | 4/1981 | Wingert | 70/312 X |
| 4,327,566 | 5/1982 | Ling | 70/312 |

FOREIGN PATENT DOCUMENTS

| | | | |
|---|---|---|---|
| 201957 | 8/1923 | United Kingdom | 70/25 |

*Primary Examiner*—Lloyd A. Gall

[57] ABSTRACT

A combination padlock includes a casing, a shackle having a longer leg formed with plural projections thereon and a shorter leg adapted to be locked into a socket formed on the casing, a plurality of sleeves each having several keys formed on the outer perimeter and an inner annular extension having a slot operatively engaging with the shackle projections for locking purpose or disengaging the shackle by passing the shackle projections through the slot for opening purpose, and plural dials each operatively engaging or disengaging with each sleeve within each dial for changing or setting a combination of the lock by operating the shackle.

6 Claims, 10 Drawing Figures

ANTI-SENSING LOCKING MECHANISM FOR COMBINATION PADLOCK

BACKGROUND OF THE INVENTION

Feinberg et al. taught a combination padlock in their U.S. Pat. Not. 3,720,082 issued on Mar. 13, 1973 as constructed by multiple dials, and multiple sleeves rotatably mounted on a shackle enabling the changing or setting of a lock combination, which however has the following defects:

1. The shackle 50 is locked by limiting the sleeves D as obstructed by several extensions 84 formed on the casing. Each sleeve has only a "single point" on its perimeter resiliently acting on each extension 84 as tensioned by the spring F, to thereby possibly be sensed after repeated trials by an intruder's feeling to open such a lock easily, especially by an experienced theirf.

2. All the sleeves are rotatably mounted on the shackle as retained between an upper retainer 64 and a lower retainer 62 to thereby increase their assembly difficulty and to cause their operation inconvenience, since the looser fixation of the two retainers 64, 62 may influence the precision for uncoupling the sleeves from the dials when setting a new combination, whereas too tight fixation of the two retainers may cause the common rotation of two or more neighboring dials frictionally contacting with each other to influence the dialing operation.

Even a latching device and combination locking means was disclosed by the same inventor in his U.S. Pat. No. 4,327,566, such a combination lock is especially suitable for locking a brief case, but still has the following defects:

1. Upon the changing or setting of a new combination, the button 60 is depressed toward B2 to uncouple the sleeves from the dials for setting a new combination and then recovered to its original position. Since such a linear movement of the button 60 and shaft 20 is easily done, any incidental contacat of the dials may change the combination to confuse the owner if he forgets to memorize the new set combination.

2. A latching piece 10 must be further provided besides the shaft 20 to lock the eyepiece to increase their production cost and operation inconvenience.

The present inventor has found the defects of conventional combination lock and invented the present padlock with projected shackle.

SUMMARY OF THE INVENTION

The object of the present invention is to provide a locking mechanism for a combination padlock including a casing, a shackle having its one leg formed with plural projections thereon and having the other leg of the shackle operatively locked into a socket of the casing, plural sleeves operatively locking or releasing the projected shackle and plural dials each operatively engaging or disengaging with each sleeve for changing or setting the combination, to thereby form a combination lock having a separable shackle locked in or released from the sleeves operatively held within the casing for better security, easier operation, lower production cost and minor maintenance problems.

DETAILED DESCRIPTION

Figure 1:
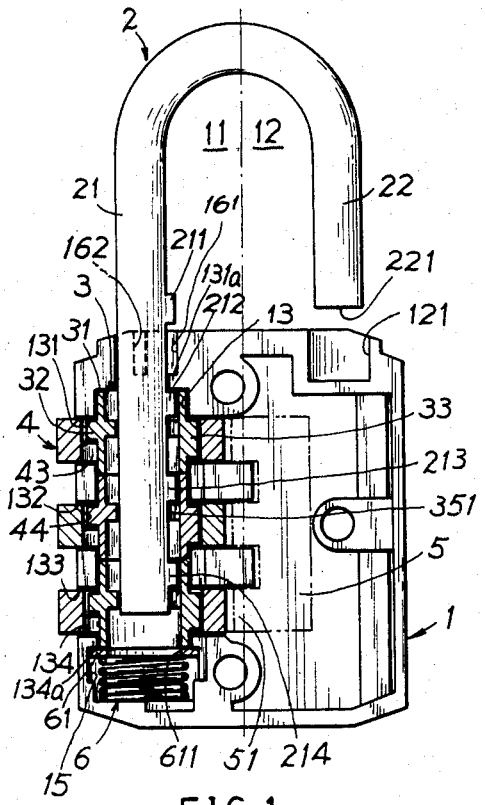
FIG. 1 is a sectional drawing of the present invention as opened.

As shown in the figures, the present invention comprises: a casing 1, a shackle 2, a plurality of sleeves 3 and a plurality of dials 4.

The casing 1 includes a left portion 11 and a right portion 12. A vertical cylindrical hole 13 is longitudinally formed on the left portion 11. Three horizontal dial slots 14 are transversely formed on the left portion 11 to intersect the vertical cylindrical hole 13 to form four collars 131,132, 133, 134 and each dial slot 14 is adapted for mounting each dial 4 therein. A spring socket 15 is formed under the vertical hole 13 for the insertion of a compression spring 6 normally tensioning a retainer 61 positioned under the lowest sleeve 3. The retainer 61 is formed with a central hole 611 for passing a first leg 21 of the shackle 2 therethrough. A shackle hole 16 is formed on the top portion of the casing 1 to free insert the shackle 2. A right projection socket 161 is formed on the right side of shackle hole 16 adapted for engaging an uppermost projection 211 of the shackle 2 when locked. A rear projection socket 162 is formed on the rear side of the shackle hole 16, at 90 degrees apart from the socket 161 adapted for inserting the projection 211 when setting a new combination.

The shackle 2 includes a first leg 21 having a plurality of projections 211, 212, 213, 214 longitudinally formed on the lower portion of first leg 21 as equally spaced, and a second leg 22 shorter than the first leg 21 having a latching end 221 operatively inserted in a latching socket 121 formed on the right portion 12 of casing 1.

The uppermost projection 211, of course, may be optionally spaced apart from the second projection 212 depending upon the practical requirement.

Each dial 4 includes 10 numerals (0, 1, 2 . . . 9) 41 formed on the outer dial perimeter having a notch 42 defined between every two numerals 41 and resiliently held by each of three branched end plates 51 of an E-shaped spring plate 5 formed in the right portion 12 as shown in FIG. 1 for stepwise rotation of the dial, and ten recesses 44 formed on an upper half circumference of bore 43 of the dial 4 each corresponding to each numeral 41 formed on the outer perimeter. The diameter of bore 43 should be limited and projectively defined within the lower periphery of each collar 131, 132 and 133 as shown in the figures.

Each sleeve 3 rotatably mounted on the shackle 2 includes plural coupling keys 32 formed on a central outer perimeter of the sleeve, each having a central angle less than 36 degrees around a center of each sleeve 3 and having a half height of that of the dial 4, an individual setting key 33 also formed on a central outer perimeter of the sleeve having a central angle less than 36 degrees around the center of the sleeve 3 and having a height equal to that of the dial 4 and operatively moving along a longitudinal key groove 130 formed across the collars 132, 133 and 134 of casing 1, and an annular extension 35 formed on a central circumference of the sleeve bore 34 having a sleeve slot 351 on the annular extension 35 to be projectively relative to the outer setting key 33 adapted for free passing of the projections 212, 213, 214 of the shackle 2. Each coupling key 32 is operatively engaged with each recess 44 of the dial 4. The height of the annular extension 35 is preferably one fifth of the height of the sleeve 3 and the height of each projection 211, 212, 213, 214 is preferably two fifths of the height of the sleeve 3. A center-to-center spacing of the projections 212, 213, 214 is equal to the height of the sleeve 3. The sleeves 3 are superimposedly inserted in the vertical cylindrical hole 13 with the uppermost sleeve being limited by an upper annular extension 131*a* defined between an uppermost collar 131 and the shackle hole 16, and with the lowest sleeve normally retained by the retainer 61 as restored by the spring 6 in which the retainer 61 is upwards limited by a lower annular extension 134a as defined between the lowest collar 134 and the spring socket 15. The number of the keys 32 are not limited in the present invention and can be at least one key.

Figure 2:
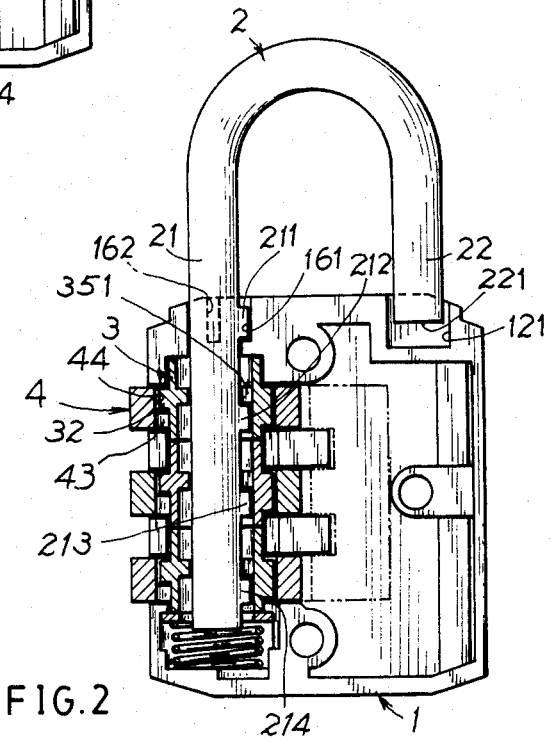
FIG. 2 shows the present invention as locked.

When locking the present invention as shown in FIG. 2, the shackle 2 is depressed downwards to insert the latching end 221 into socket 121 and the uppermost projection 211 inserted into the right projection socket 161, and the second projection 212, the third projection 213 and the fourth projection 214 positioned under projection 211 are respectively engaged under each annular extension 35 of each sleeve 3 whereby upon the rotation of each dial 4 to synchronously rotate the engaged sleeve 3, each sleeve slot 351 will be rotated to deviate from each projection 212, 213 or 214 to lock the shackle 2 without being pulled upwards. When rotating the dials toward the sharp "opening" combination as pre-set, the slots 351 will meet the projections 212, 213, 214 to allow the shackle leg 21 to be pulled upwards for opening the lock as shown in FIG. 1.

Figure 3:
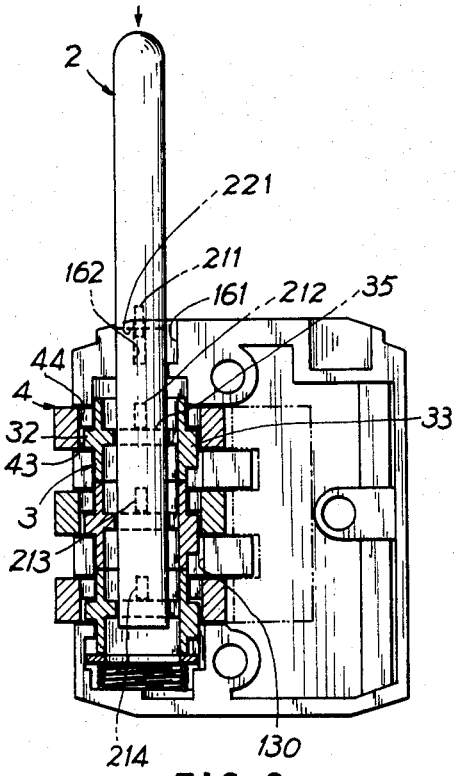
FIG. 3 shows the present invention when rotating a shackle at 90 degrees and depressing the shackle downwards.
Figure 5:
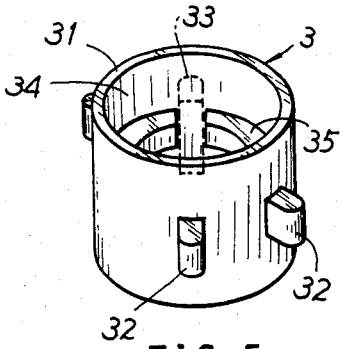
FIG. 5 is a perspective view of a sleeve of the present invention.
Figure 6:
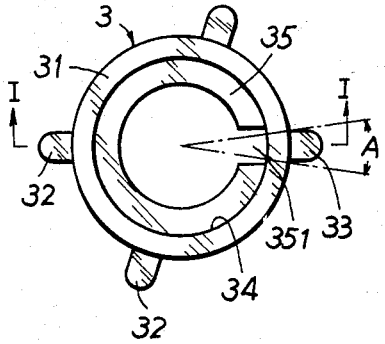
FIG. 6 is a top view of the sleeve of the present invention.
Figure 4:
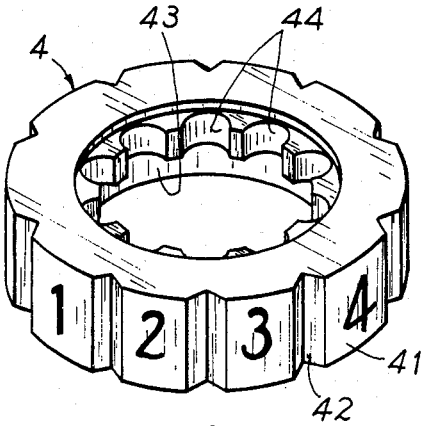
FIG. 4 is a perspective view of a dial of the present invention.
Figure 7:
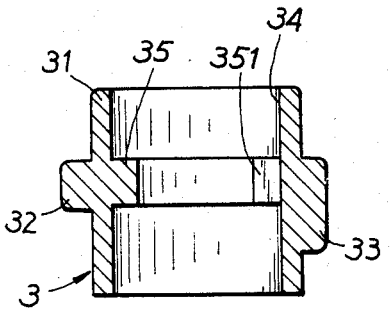
FIG. 7 is a sectional drawing of the sleeve when viewed from I—I direction of FIG. 6.
Figure 9:
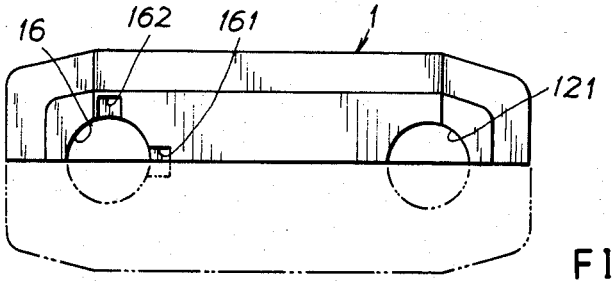
FIG. 9 is a top view of FIG. 8.
Figure 8:
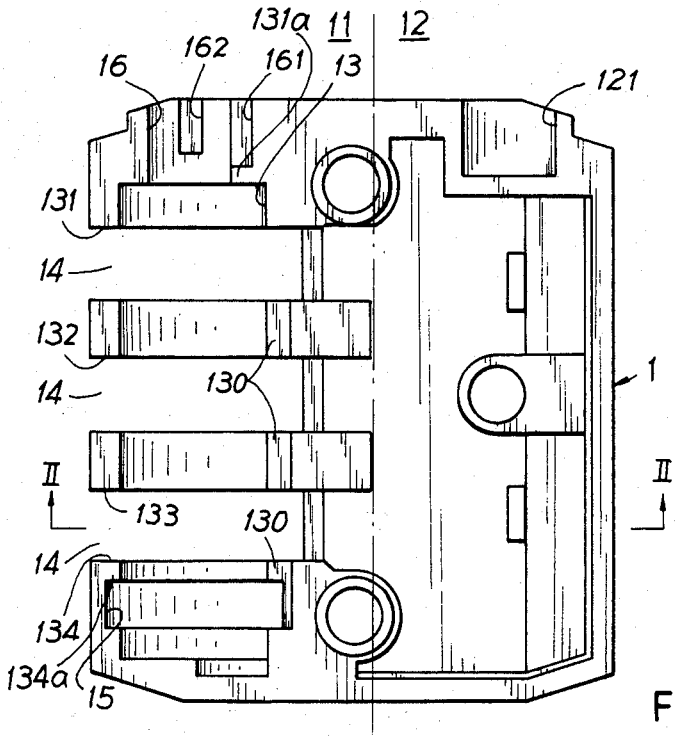
FIG. 8 is an illustration showing the casing of the present invention.
Figure 10:
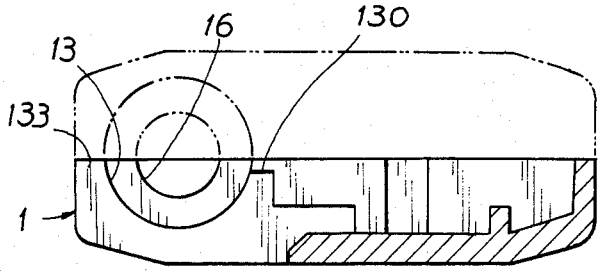
FIG. 10 is a bottom view of the casing as viewed from II—II direction of FIG. 8.

Then, the shackle 2 is rotated in an angle such as 90 degrees as shown in FIG. 3 along the axis of the shackle leg 21 and cylindrical hole 13 and upon the depression of the shackle 2 downwards, the uppermost projection 211 is inserted into the rear projection socket 162 and the other projections 212, 213, 214 are each acting on each annular extension 35 of each sleeve 3 downwards against the resilient force of the spring 6 (the setting keys 33 being downwards moved along the groove 130) so as to uncouple the coupling keys 32 from the recesses 44 of the dials 4, whereby the dials can be optionally rotated for setting a new combination and when releasing the shackle 2, the spring 6 will restore the sleeves 3 upwards to re-couple the keys 32 with the recesses 44 to finish the setting operation. Then, the shackle 2 is rotated back to its original position as shown in FIGS. 1 and 2.

The present invention has the following advantages superior to a conventional combination lock or other latching device;

1. All sleeves 3 are each retained against each collar 131, 132, 133 so as to homogeneously distribute the resilient force as backed by the spring 6 toward the lower perimeter of each collar. So, if any intruder or thief tries to open this lock by trials, he will depress the shackle and rotate the dials 4, trying to find out the position of each slot 351 to uncouple the shackle projections from each sleeve. However, the depression of shackle 2 will be first obstructed by the projection socket 161 to ignore the resilience feeling as backed by the spring 6 and each sleeve 3 may thoroughly distribute the spring force onto each collar 133, 132, 131, to thereby eliminate the spring force to minimize the touch feeling by such an intruder. Accordingly, this invention may provide a better security.

2. The shackle 2 is separable from the sleeves 3 for easier assembly, convenient operation and lower production cost.

3. The number of the keys 32 can be reduced to a minimum (e.g. at least one key) to save their cost, especially supreior to Feinberg's patent.

I claim:

1. A locking mechanism for a combination padlock comprising:

a casing including a vertical cylindrical hole longitudinally formed on a left portion of the casing, a plurality of horizontal dial slots transversely formed on the left portion of the casing to intersect the vertical cylindrical hole to form plural collars adapted for mounting a plurality of dials therein, a spring socket formed under said vertical cylindrical hole for inserting a compression spring therein, a latching socket formed on a right portion of said casing, a right projection socket and a rear projection socket apart from said right projection socket at an angle of 90 degrees formed on the top portion of the left portion of said casing, and a longitudinal key groove formed across the plural collars of said casing;

a shackle having a first leg formed with a plurality of projections longitudinally formed on the first leg and a second leg shorter than said first leg having a latching end operatively inserted into said latching socket on said casing, an uppermost projection of said shackle operatively engaging with either said right or said rear projection socket of said casing;

a plurality of sleeves rotatably mounted on said shackle each including at least one coupling key having a half height of the height of a dial and an individual setting key formed on a central outer perimeter of each sleeve, each key having a central angle less than 36 degrees around a center of said sleeve, and an annular extension formed on a central circumference of a bore inside said sleeve having a sleeve slot projectively relative to said individual setting key, said annular extension operatively engaging each said projection of said shackle except said uppermost projection under said annular extension and operatively allowing free passing of said projections through said sleeve slot formed on said annular extension, all said sleeves being superimposedly inserted in said vertical cylindrical hole and having the lowest sleeve retained by a retainer as normally tensioned by said compression spring inserted in said spring socket, each said setting key operatively moving along said longitudinal key groove formed on said collars of said casing; and a plurality of dials each including ten numerals formed on the outer perimeter of each dial having a notch formed between every two neighboring numerals and ten recesses circumferentially formed on an upper half circumference of a bore of each dial operatively engaging with said keys of said sleeve, whereby upon the rotation of each dial to synchronously rotate the engaged sleeve to deviate the sleeve slot of each said sleeve from said projection of said shackle, each projection of said shackle is engaged under the annular extension of each said sleeve to thereby lock said shackle in said casing, and upon the rotation of said shackle at an angle from its locking position and upon the depression of said shackle downwards to force said projections downwardly on said annular extensions to uncouple said sleeves from said dials, said dials can be optionally rotated for setting a new combination.

2. A locking mechanism for a combination padlock according to claim 1, wherein said coupling key of said sleeve has half height of that of said setting key.

3. A locking mechanism according to claim 1, wherein a center-to-center spacing of the projections of said shackle except its uppermost projection is equal to the height of said sleeve.

4. A locking mechanism according to claim 1, wherein a diameter of said bore of said dial is limited and projectively defined within a lower periphery of each said collar of said casing.

5. A locking mechanism according to claim 1, wherein said retainer of said compression spring is formed with a central hole adapted for the downward movement of said shackle.

6. A locking mechanism according to claim 1, wherein said annular extension has a height of one fifth of the sleeve height and said projection of said shackle has a height of two fifths of the sleeve height.

* * * * *